US005443554A

United States Patent [19]

Robert

[11] Patent Number: 5,443,554

[45] Date of Patent: Aug. 22, 1995

[54] POSITIONING DEVICE FOR WOODWORK

[76] Inventor: Denis Robert, P.O. Box 1916, Val d'Or Quebec, Canada, J9P 6C5

[21] Appl. No.: 156,726

[22] Filed: Nov. 24, 1993

[51] Int. Cl.[6] ..... B27B 27/10

[52] U.S. Cl. ..... 83/468.7; 83/467.1; 269/303; 269/304; 269/315

[58] Field of Search ..... 83/468.7, 467.1, 468, 83/435.1; 269/303, 304, 306, 315, 319

[56] References Cited

U.S. PATENT DOCUMENTS

| | | | |
|---|---|---|---|
| 691,715 | 1/1902 | Dodd | 83/468.7 |
| 751,121 | 2/1904 | Tidey . | |
| 867,081 | 9/1907 | Robinson | 269/306 |
| 957,782 | 5/1910 | Leaver, Jr. . | |
| 2,112,789 | 3/1938 | Ross | 269/315 |
| 2,316,971 | 4/1943 | Overacker et al. . | |
| 2,485,274 | 10/1949 | Garrett . | |
| 2,890,729 | 6/1959 | Horn | 269/315 |
| 4,256,000 | 3/1981 | Seildel . | |
| 4,691,607 | 9/1987 | Webb . | |
| 4,693,158 | 9/1987 | Price | 269/303 |
| 4,946,149 | 4/1990 | Greene . | |
| 4,972,749 | 11/1990 | Grove . | |
| 5,018,562 | 5/1991 | Adams | 83/468.7 |
| 5,085,414 | 2/1992 | Weaver | 269/304 |

*Primary Examiner*—Eugenia Jones
*Assistant Examiner*—Allan M. Schrock
*Attorney, Agent, or Firm*—Robic

[57] ABSTRACT

A positioning device for use with a table saw including a worktable with a transverse beam transversal to the saw, along which a workpiece stop member may slide. The device has an elongated support fixed to the transverse beam of the worktable. A plurality of block members are slidably mounted along the support and are lockable anywhere on this support. An alignment arm is connected to the stop member so as to be movable therewith. This arm has at least one protuberance that is engageable with any preselected block member to lock the stop member in a given position away from the saw. The device allows for easy and infinitely precise positioning of the alignment arm and stop member plate for a workpiece placed on the worktable. It further allows for a rapid "programming" of the positioning of a plurality of workpieces to be sawed.

2 Claims, 5 Drawing Sheets

FIG. 4
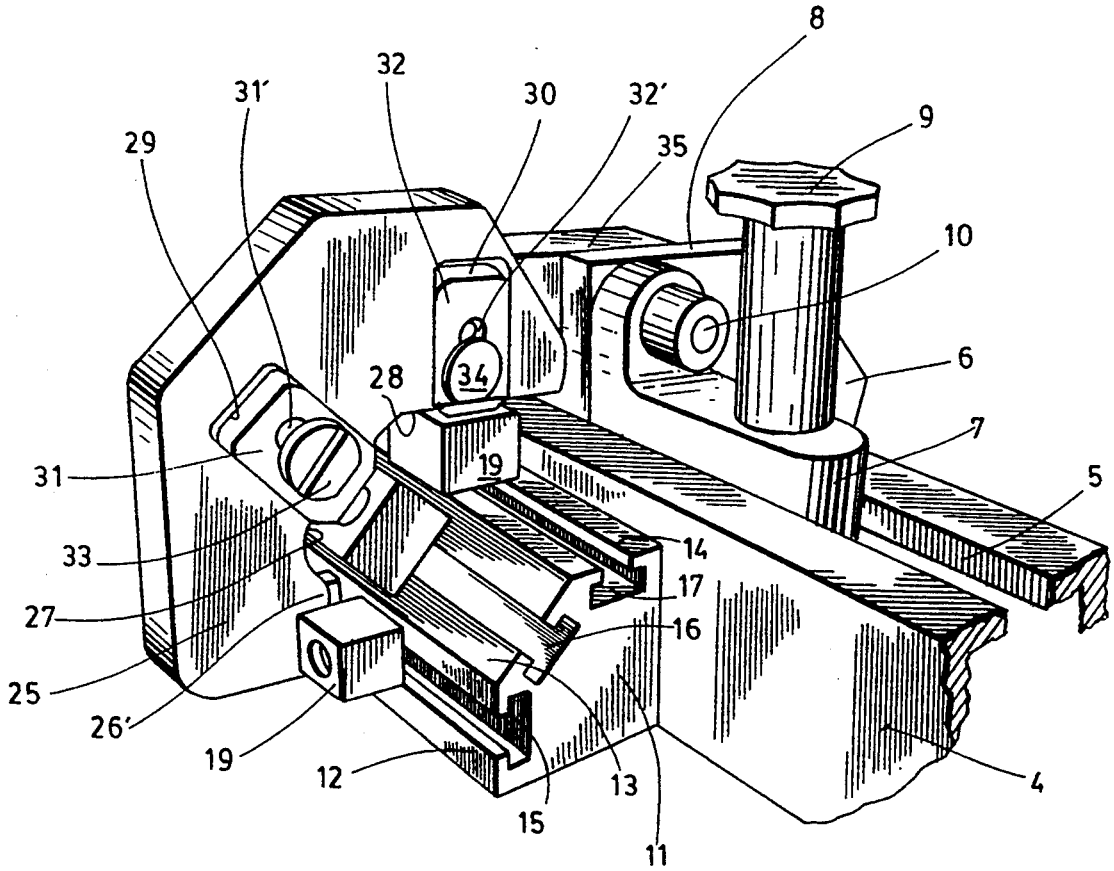
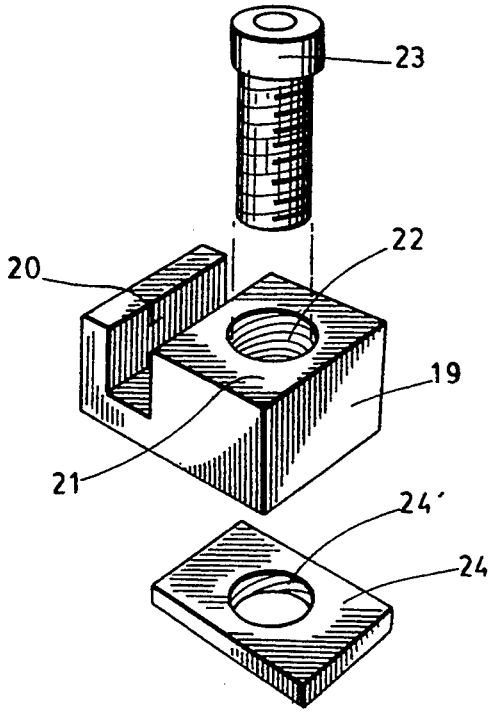
FIG. 5

POSITIONING DEVICE FOR WOODWORK

BACKGROUND OF THE INVENTION a) Field of the Invention

The present invention is concerned with a positioning device for use on a woodwork table having a circular saw mounted thereon.

More particularly, the invention is concerned with a device specially adapted to properly position and hold a wood piece to be sawn at a proper location on a woodwork table of the above mentioned type, which is commonly called in the trade as a "table saw" or "saw husk".

b) Brief Description of The Prior Art

Using tablesaw which may or not be of the movable type, involves positioning the workpiece to be cut on the table. For this purpose, it is known to provide an abutment or fence against which the workpiece may bear. A problem arises as to how to hold the workpiece in accurate position corresponding to a required length or width for cutting. It is also known to provide stop means against which the workpiece may be leaned to achieve such an accurate position.

For instance, U.S. Pat. No. 751,121 issued on Feb. 2, 1904 to C. H. Tidey discloses a saw table having a plurality of sliding gauges stopped by brackets. The latter are limited to a small number and each gage is secured to its bracket by a set screw. Every time that a worker needs a measurement which is not available from any of the gages, a re-setting is necessary.

U.S. Pat. No. 4,256,000 issued on Mar. 17, 1981 to C. Seidel discloses a table saw including a worktop designed to provide an abutment for a plurality of boards of the same length.

U.S. Pat. No. 4,961,607 issued on Sep. 8, 1987 to F. A. Webb, discloses a positioner which may be located on either side of a radial arm saw. Such positioner is not suited to rapid location of different saw measurements.

U.S. Pat. No. 4,972,949 issued on Nov. 27, 1990 to J. S. Grove, discloses a radial arm saw including a calibrated fence having a plurality of stop gauge members that are slidably mounted in fence units. This construction does not allow for infinitely precise measurements. Also, the stop gauge members are spring-loaded and therefore prone to wearing out and breakage.

The follow U.S. patents are also of interest in this very particular field:

U.S. Pat. No. 957,782 issued on May 10, 1910 to J. M. Leaver et al

U.S. Pat. No. 2,485,274 issued on Oct. 18, 1949 to R. G. Garret; and

U.S. Pat. No. 4,946,149 issued on Aug. 7, 1990 to D. G. Greene.

In general, most of the table saws presently available in the trade, like the one sold by the german company HOLZ-HER, are provided with a calibrated abutment beam which is mounted onto the worktable so as to extend transversally to the sawing direction. A screwable stop member is adjustably displacable along the beam and has an element which serves as a stop for the workpiece, so that the latter does not slip or otherwise move on the worktable transversally away from the saw during the sawing action. The stop must be manually positioned along the beam according to the desired dimension of the workpiece for each cutting operation.

This basic structure is quite efficient. However, a significant difficulty arises when one wants to saw a plurality of boards, panels and the like at one time. The workpieces may be required to be of the same or different dimensions, or a combination of both. Thus, for each piece to be worked, the stop member has to be unscrewed, positioned anew and re-tightened. This, of course is non-productive, time-consuming and a source of error.

OBJECT AND SUMMARY OF THE INVENTION

The object of the present invention is to provide a positioning device for use with a table saw like the one sold by HOLZ-HER, which obviates the above-stated problem inherent in sawing at one time a plurality of workpieces of different and/or identical predetermined dimensions. More particularly, the object of the invention is to provide a positioning device of the above type, which is simple to use, very efficient and infinitely precise.

More particularly, the invention as broadly claimed hereinafter, lies in the provision of a positioning device adapted to be used in combination with a table saw of the type comprising a circular saw extending in a given direction and a worktable that is movable in said given direction relative to the saw. This worktable is provided with a abutment beam perpendicular to the surface of the saw and with a transverse stop member that is slidably movable along the beam, the stop member comprising an abutment plate which is pivotally secured to it in such a manner as to form a stop on the worktable on one side of the beam when pivoted in downward position.

The positioning device according to the invention comprises an elongated slide support that is secured to another side of the beam opposite to the one on which the abutment plate may form a stop. The slide support is formed with at least one rail-defining surface and preferably three such rail-defining surfaces, one horizontal, one inclined and one vertical.

The positioning device also comprises at least two, and preferably more than two block members slidably mounted on one or more of the rail surfaces so as to be infinitely precisely positioned anywhere along the length of the slide support. Lock means are provided to secure each block in place at any selected position along the slide support.

The positioning device further comprises an alignment arm pivotally secured to a lug forming part of the stop member. The arm may pivot from an upright disengaged position to a lowered, block-engaging position.

Co-operating engagement means are provided on the arm and on each block to allow releasable engagement of the same after the blocks have been set at predetermed distances from the saw and the stop member has been slid along the beam to reach a selected one of these blocks.

When the support member is formed with three rail-defining surfaces as explained hereinabove, the alignment member has a curved profile which defines a vertical bottom surface provided with an endmost projection adapted to engage a slot formed in each of the block members mounted on the vertical rail-defining surface of the slide support. The alignment member also has second and third bottom surfaces adapted to closely overly the inclined and horizontal rail-defining surfaces of the slide support, respectively. Each of these two other bottom surfaces has a slidable plate mounted in a cutout portion, which is designed to engage the slot formed in each of the block members mounted on the inclined and horizontal, rail-defining surfaces, in precise alignment therewith. As can be understood, the end-most projection and the slide plates of the arm and the slots of the block members form, in this particular case, the cooperating engagement means mentioned hereinabove.

In the event that one block member of either the inclined or horizontal rail-defining surface of the slide support is aligned with the arm when the same is positioned to engage a given block member of the vertical, rail-defining surface, then the non-engaged plate will simply rest upon the one block member. Thus, the worker only has to carefully set the block members in position; afterwards it is a matter of moving the alignment arm and abutment plate to engage the proper blocks.

BRIEF DESCRIPTION OF THE DRAWINGS

The invention and its numerous advantages will be better understood upon reading of the following, non-restrictive description of a preferred embodiment thereof, given with reference to the accompanying drawings, in which:

FIG. 4 is another perspective view similar to the one of FIG. 3, showing the alignment arm in operative position, this view also showing the stop member and a section of the abutment beam;

FIG. 5 is a perspective view of a block member and of its associated parts.

DESCRIPTION OF A PREFERRED EMBODIMENT

Figure 1:
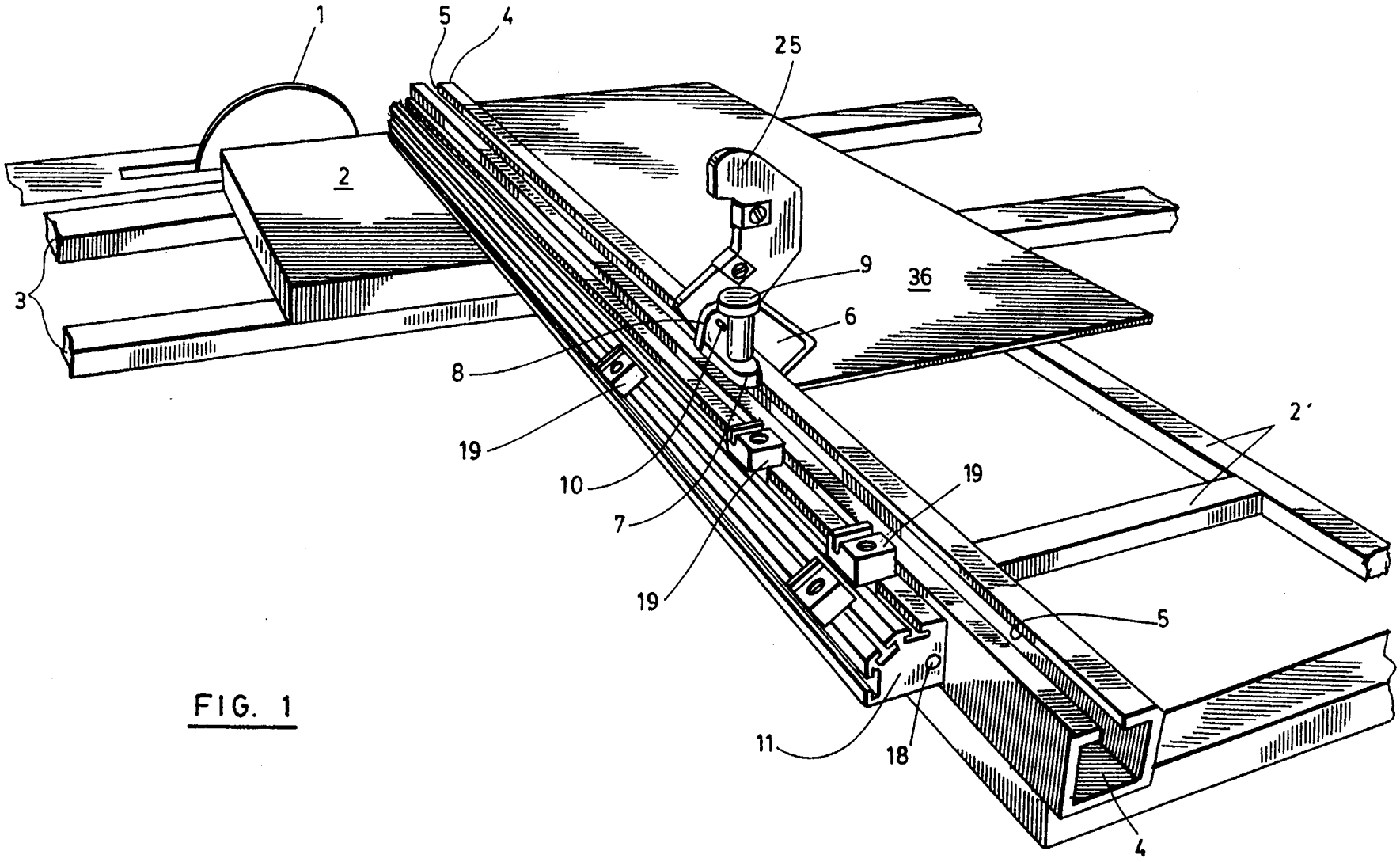
FIG. 1 is a perspective view of a table saw including a circular saw and a worktable provided with an abutment beam, this view also showing a positioning device according to the invention in combination with the table saw.
Figure 2:
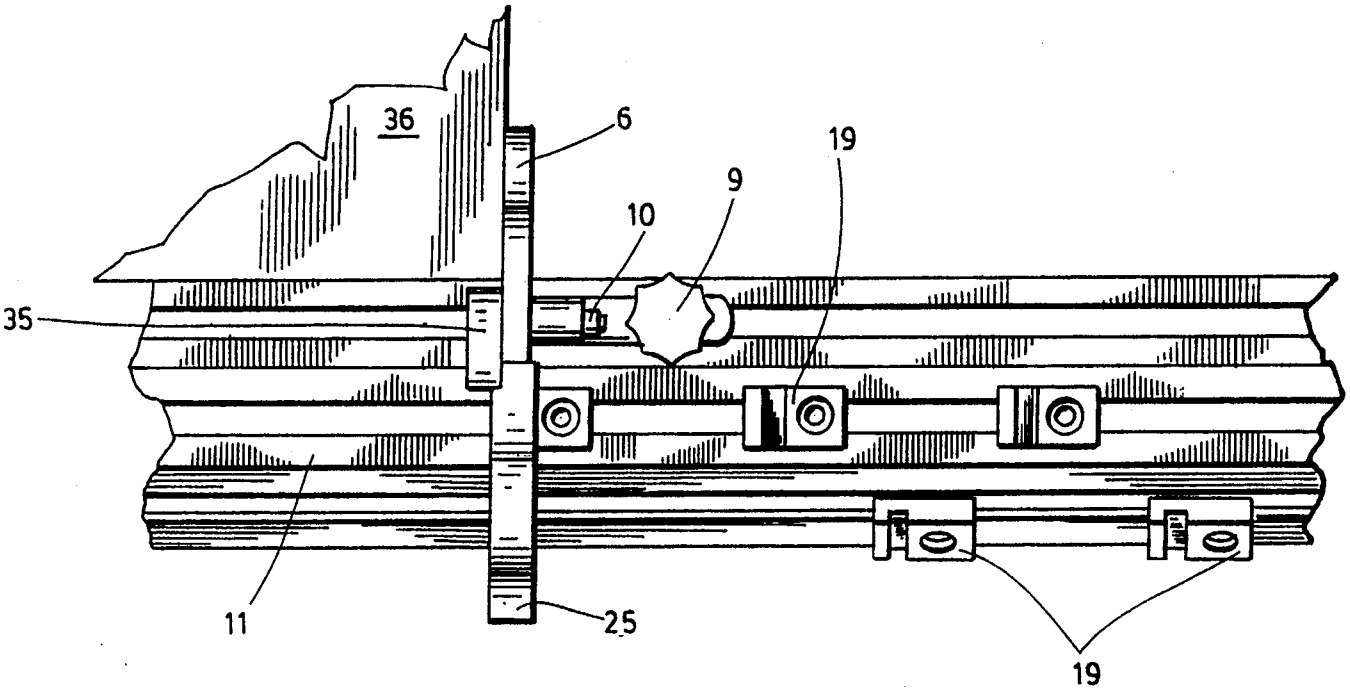
FIG. 2 is a top plan view of the support member, of several block members, of the alignment arm, of the abutment plate, of the bar and of the tightening knob of the positioning device shown in FIG. 1.
Figure 6:
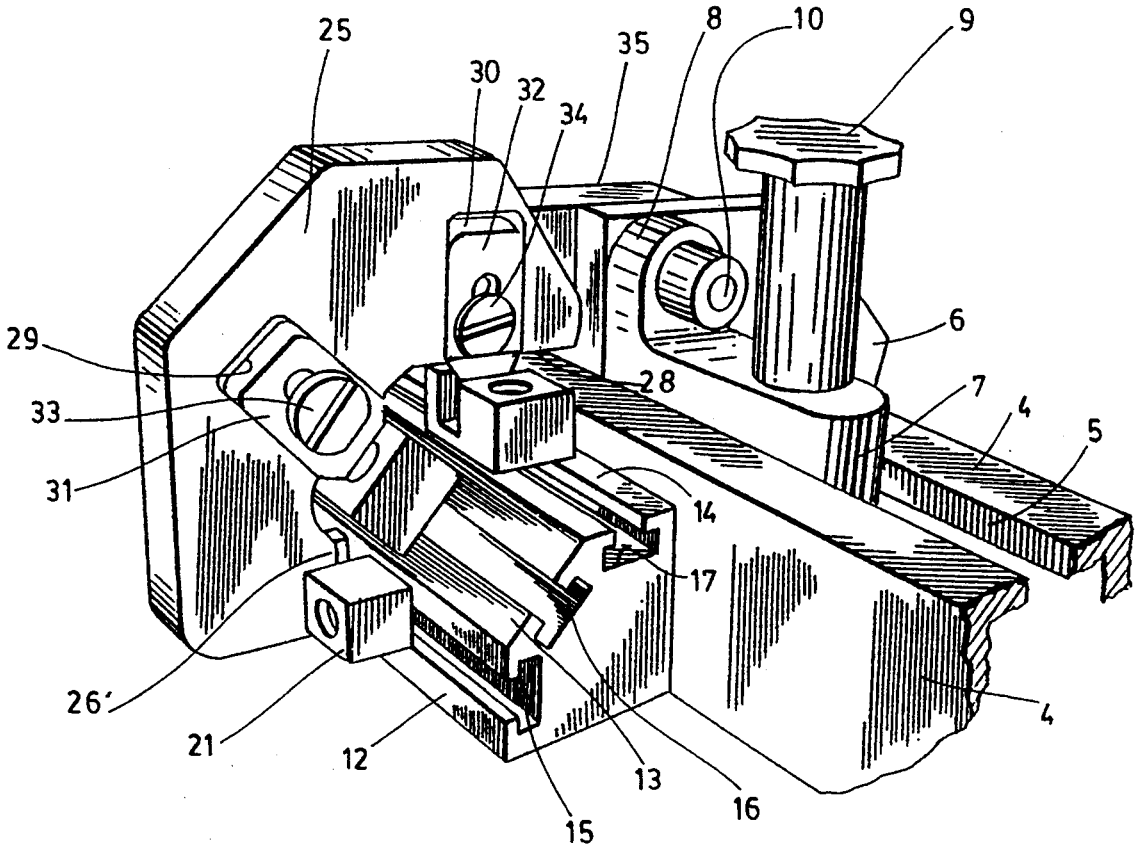
FIG. 6 is a perspective view similar to that of FIG. 4 but showing different blocks engaged by the alignment arm.

FIG. 1 shows a table saw of conventional structure, including a circular saw 1 and a worktable 2 mounted on supporting rails 3 extending in a direction parallel to the plane in which the circular saw extends. The worktable 2 comprises a frame 2 on which the workpiece 36 to be sawn may be laid flat, and a transverse abutment beam 4. The beam 4 has a rear surface that is calibrated, and a top surface in which a groove 5 is formed. This groove is adapted to receive a slidable stop member. The stop member includes a horizontal bar 7, an upright lug 8 secured to the end of the bar which is the closest to the saw 3, and a tightening knob 9. A work abutment plate is pivotally mounted onto the lug 8 about a short pivot rod 10 that extends parallel to the beam 4. The plate 6 may pivot from a raised, inoperative position as shown in FIG. 1, to a lower operative position as seen in FIGS. 4 and 6.

The basic structure of the above described table saw is known per se and needs not be further detailed.

The positioning device according to the invention is adapted to fit to and be used with the above table saw. This device comprises an elongated slide support 11 that can be made of metal such as aluminum, and is adapted to be secured by screws 18 or the like, to the front surface of the abutment beam 4, opposite to the one where extends the abutment plate 6 when the same is in operative position.

The slide support 11 has at least one rail defining surface. In the illustrated embodiment, it has three such surfaces, including a vertical rail-defining surface 12, an inclined rail -defining surface 13 and a horizontal rail-defining surface 14. The surfaces 12, 13, 14 are provided with cross-sectionally inverted T-shape slide channels 15, 16, 17 respectively, which make them useful as rails.

It must be understood that the slide support could have less or more than three rail-defining surfaces and would similarly be efficient, the number of surfaces increasing only the number of available positions for the stop member along the beam, as will be explained hereinafter.

Figure 3:
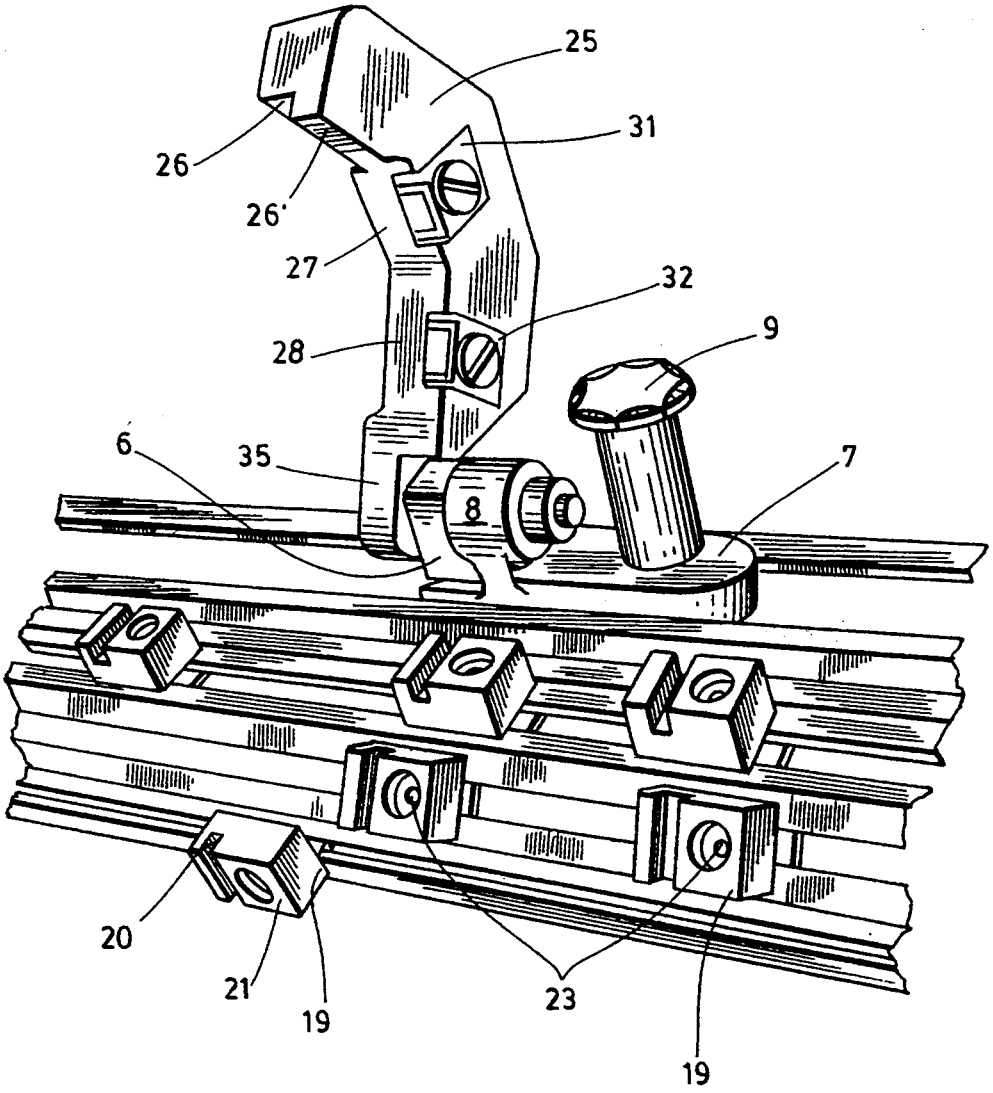
FIG. 3 is a perspective view of the alignment arm and of part of the support member of the device according to the invention in a non-use position, this view also showing the stop member.

A plurality of identical block members 19 are slidably mounted in the channels 15, 16 and 17 as clearly seen in FIG. 3. Each block member 19 consists of a block rectangular in shape and has an upper surface provided with a slot 20 transversal to the slide support 11 and beam 4. Referring to FIG. 5, each block has a top surface 21 across which the slot 20 extends a hole 22 with an upper counterbore extending perpendicularly to the top surface 21. Each block also has an associated small plate 24 which has a central threaded hole 24'. The plate 24 of each block is adapted to slide into any one of the channels 15, 16 and 17. A bolt 23 passing through the hole 22 and threadedly engaged in the hole 24' acts as a locking means to lock the block at any preselected location along the corresponding rail-defining surface of the slide support 11.

As shown in FIGS. 3, 4 and 6, the positioning device according to the invention also comprises an alignment arm 25 having a generally curved profile. The arm 25 is pivotally mounted onto the lug 8 of the slidable stop member via a connection bar 35 fixed to the pivot rod 10 so that the arm 25 extends in substantially the same plane as the abutment plate 6. The arm 25 may thus pivot from an upright disengaged position to a lowered block-engaging position.

The arm 25 is formed at its lower portion with three bottom surfaces 26, 27, 28, which, when the arm is in lowered position are vertical, inclined and horizontal, respectively. The bottom surface 26 is formed with a projection 26'. Preferably the middle surface is inclined at a 45 degree angle. The surfaces 27 and 28 each have a cutout portion 29, 30, respectively, in which small engaging plates 31, 32 are slidably mounted in a free manner. Each plates 31, 32 is formed with a longitudinal slot 31', 32'. Thus the two plates 31, 32 are adapted to freely slide in and out within the cutout portions 29, 30, respectively.

As can now be understood, the arm 25 may engage only one block 19 positioned in one of the three surfaces. 12, 13 or 14, even if these blocks are very close to each other. In the position shown in FIG. 4, the protuberance 25' is engaged in a block member 19 mounted onto the vertical surface 12 of the slide support. In such a position, the engaging plates 31, 32 are in retracted positions within there cut-out portions 29,30, thereby giving room to the blocks 19 fixed to the other surfaces of the slide support. In the position shown in FIG. 6, the engaging plate 32 is engaged in the slot 20 of an adjacent block. In such a case, the plate 31 can be in retracted position if there is a block on the inclined rail-defining surface as shown. However, there cannot be any block of the vertical surface 12, as such a block would interfere with the projection 26' and would permit the arm from being fully pivoted down.

In use, after the blocks have been properly positioned where they are desired and the knob of the stop member has been unscrewed, a workman may select any block on any of the three surfaces, then move the abutment plate 6 and alignment arm 25 along the beam 4 until they are in front of this block, and finally lock the arm 25 by insertion of either one of its plates 31, 32 or protuberance 26' into the slot 20 of the selected block 19. This can be done very rapidly and very efficiently, with a precision of 1/64" or more. If desired, the blocks can be marked with color-coded stickers so that a whole sequence of sawing may be "programmed" in advance.

In practise, the blocks may be set in place by moving the abutment member in a desired position, using the calibration on the beam to do so.

I claim:

1. A positioning device, for use in combination with a table saw of the type comprising a circular saw extending in a given direction and a worktable that is movable in said given direction relative to the saw, said worktable being provided with an abutment beam perpendicular to said given direction and with a transverse stop member that is slidably movable along the beam, said stop member comprising an abutment plate which is pivotally secured to the beam in such a manner as to form a stop on the worktable on one side of the beam when pivoted in a downward position, said positioning device comprising:

(a) an elongated slide support secured to another side of the beam that is opposite to the one on which the abutment plate extends, said slide support being formed with rail-defining surfaces;

(b) at least two block members slidably mounted on said rail-defining surfaces to as to be positionable anywhere along the length of the slide support;

(c) lock means for securing each block member in place at any selected position along the slide support;

(d) an alignment arm pivotally secured to a lug forming part of the stop member, said alignment arm extending substantially in line with said stop member and being pivotable from an upright, disengaged position to a lowered, block-engaging position; and (e) cooperating engagement means provided on the arm and on each block member to allow releasable engagement of said arm with said block members after the block members have been set at predetermined distances from the saw and the stop member has been slid along the beam to reach said block members, said cooperating engagement means including a slot formed in each of the block members and a projection projecting from said alignment arm to engage said slot when said arm is in its lowered position;

wherein the rail defining surfaces include three rail-defining surfaces, one horizontal, one inclined and one vertical, and wherein the alignment arm has a curved profile which defines a vertical bottom surface provided with an endmost projection adapted to engage the slot of each block member mounted on the vertical rail-supporting surface, said alignment arm also having second and third bottom surfaces adapted to closely overlie the inclined and horizontal rail-defining surfaces of the slide support, respectively, each of these two other bottom surfaces having a slidable plate retractably mounted in a cutout portion, said slidable plate being designed to engage the slot formed in each of the block members mounted on the inclined and horizontal rail-defining surfaces when said plate is in precise alignment with said slot, and to retract when said plate is in contact with any other part of said block members.

2. The positioning device of claim 1, wherein each of said rail-defining surfaces comprises a longitudinal channel; each of said block members comprises a block; and each of said lock means comprises a through hole made in the corresponding block, and a small plate adapted to slide in said channel, said plate having a threaded hole formed therein, and a bolt adapted to pass through the through hole of the block and to be screwed into said threaded hole of the plate to lock said block and plate within the channel.

* * * * *